US008292664B2

(12) United States Patent
Funamura et al.

(10) Patent No.: US 8,292,664 B2
(45) Date of Patent: Oct. 23, 2012

(54) INTERNAL EDGE CONNECTOR

(75) Inventors: Joshua Funamura, San Jose, CA (US); Zheng Gao, San Jose, CA (US); Steve McClure, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 55 days.

(21) Appl. No.: 12/894,510

(22) Filed: Sep. 30, 2010

(65) Prior Publication Data

US 2012/0083158 A1 Apr. 5, 2012

(51) Int. Cl.
*H01R 13/648* (2006.01)

(52) U.S. Cl. ..... 439/607.31; 439/630

(58) Field of Classification Search ..... 439/607.31, 439/77, 55, 629, 630, 159, 160, 946, 326, 439/153, 152, 372
See application file for complete search history.

(56) References Cited

U.S. PATENT DOCUMENTS

| | | | | |
|---|---|---|---|---|
| 5,299,089 | A * | 3/1994 | Lwee | 361/679.33 |
| 5,876,222 | A * | 3/1999 | Gardner et al. | 439/79 |
| 6,210,174 | B1 * | 4/2001 | Pei et al. | 439/67 |
| 7,628,655 | B1 * | 12/2009 | Chen | 439/660 |
| 2009/0142944 | A1 * | 6/2009 | Zhu | 439/79 |

* cited by examiner

*Primary Examiner* — Edwin A. Leon
(74) *Attorney, Agent, or Firm* — Kilpatrick Townsend & Stockton LLP

(57) ABSTRACT

Edge connectors to connect a daughter or optional board to an edge of a main or motherboard. These connectors may have a low profile or height to save space in electronic devices, and allow electronic devices incorporating the connector have a thin form factor. These connectors may also provide for reliable manufacturing by providing a robust connection to a motherboard and easy insertion of a daughter card.

18 Claims, 5 Drawing Sheets

INTERNAL EDGE CONNECTOR

BACKGROUND

The number and types of electronic devices on the market have grown tremendously the past few years. Tablet, netbook, laptop, and all-in-one computers, media players, handheld media players, cell phones, and other devices have proliferated. These devices have proliferated not only in the types that are available, but also as to the functionality they include.

Moreover, options for some particular devices have also proliferated. For example, for a particular device, the size of an internal memory may be an option. Other functionalities, such as video or graphics cards, network connections, and others, may also be made available as options or as possible upgrades. This allows a manufacturer to offer products at several price points, and allows customers to buy only the amount of functionality that is required to suit their needs and to possibly upgrade at a later time.

In these devices, various options may be added by including an optional card or board inside a housing of the electronic device. Also, certain cards or boards may be manufactured separately, for example, by a different manufacturer. In these and other situations, it may be desirable to include the card in the electronic device as a daughter card or board. These optional or daughter cards or boards may be attached to a main or motherboard. Specifically, these optional or daughter cards or boards may be attached to a board inside the electronic device housing using a connector.

Unfortunately, these connectors consume space inside the electronic device housing. This consumed space may increase the size of the electronic device or reduce the functionality that could otherwise be included in the electronic device. In particular, the height of a connector may be of particular interest, since very thin consumer electronic devices are now popular.

Also, it may be useful to have these connectors provide for a reliable manufacturing process. Specifically, it may be useful for them to be mechanically robust and to easily accept an optional or daughter card.

Thus, what is needed are connectors that can be used to easily connect optional or daughter cards or boards to main or motherboards in electronic devices. It may also be desirable for these connectors to have a reduced size and to be mechanically robust.

SUMMARY

Accordingly, embodiments of the present invention provide connectors that have a low profile or height, provide for reliable manufacturing by providing a robust connection to a motherboard, and provide an easy insertion of a daughter card.

An illustrative embodiment of the present invention may provide a connector that may connect a daughter or optional board to a main or motherboard. When the daughter or optional board is inserted, the daughter or optional board may be approximately in line with the main or motherboard. This arrangement may help to provide a low height or profile for the connector, thus saving space and decreasing the thickness of the electronic device incorporating the connector.

Another illustrative embodiment of the present invention may provide for reliable manufacturing by providing a connector having a robust connection to a main or motherboard. In a specific embodiment of the present invention, a connector may include a number of contacts, each having a prong that may be connected to a through hole in the main or motherboard. In various embodiments of the present invention, tabs on a shield or shield portion may also connect to the main or motherboard for increased mechanical stability. In various embodiments of the present invention, these through-hole prongs and tabs may be connected to the main or motherboard by soldering or other method. In another specific embodiment of the present invention, the through-hole prongs of the connector contacts may be replaced by surface-mount pins or contacts. These contact and shield tab connections may provide a robust connection between the connector and the main or motherboard.

Another illustrative embodiment of the present invention may provide for reliable manufacturing by providing a connector having an opening for easy insertion of a daughter or optional card. In a specific embodiment of the present invention, the daughter or optional board may be held in place by a number of contact prongs on a first and second side. These contact prongs may hold the board in place with spring tension. Clips, holders, or other structures may also be used to hold the daughter or optional board in place after insertion.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
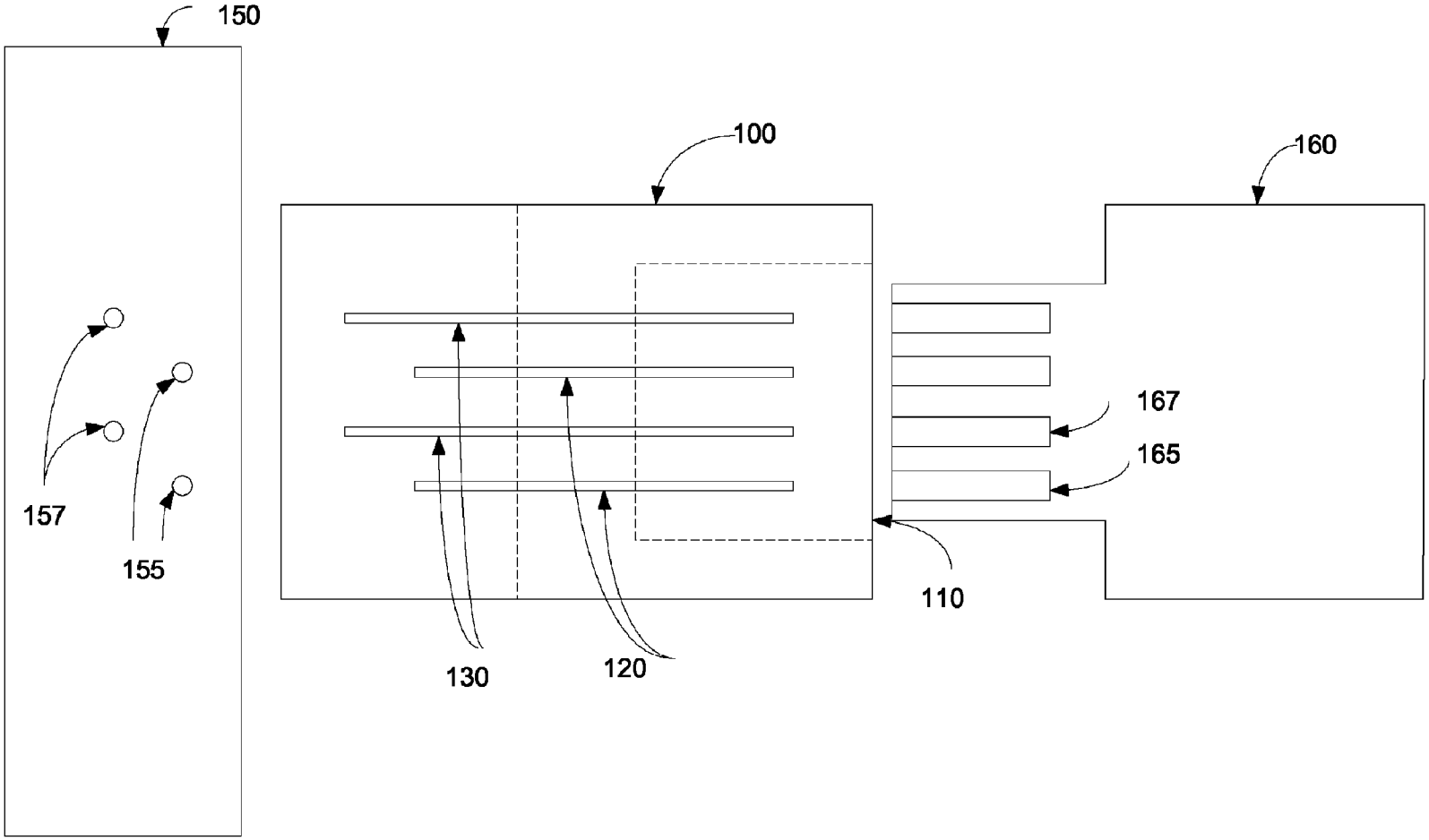
FIG. 1 illustrates a connector according to an embodiment of the present invention.

FIG. 1 illustrates a connector according to an embodiment of the present invention. This figure, as with the other included figures, is shown for illustrative purposes and does not limit either the possible embodiments of the present invention or the claims.

This figure illustrates a top view of connector 100. Connector 100 may include opening 110, first contacts 120, and second contacts 130. Contacts 120 and 130 may be used to form electrical paths between traces and circuitry on main or motherboard 150 and daughter or optional board 160.

Specifically, through-hole prongs or portions of contacts 120 may be inserted into through holes 155 in main or other board 150. Similarly, through-hole prongs or portions of contacts 130 may be inserted into through holes 157 in main or motherboard 150.

Daughter or optional board 160 may be inserted into opening 110 in connector 100. This may allow electrical connections to be formed between contacts 120 and 130 in connector 100 and contacts or pads 165 and 167 on daughter or optional board 160.

In this way, traces and circuitry on daughter or optional board 160 may connect to traces and circuitry on main or motherboard 150. Specifically, traces and circuitry on daughter or optional board 160 may connect to contacts 165 and 167. Contacts 120 and 130 in connector 100 may form electrical connections with contacts 165 and 167 on daughter or optional board 160. Contacts 120 and 130 in connector 100 may be inserted into through holes 155 and 157 on main or motherboard 150. Various traces and circuitry may connect to through holes 155 and 157 on main or motherboard 150.

Forming through-hole connections with contacts 120 and 130 in connector 100 and through holes 155 and 157 in main or motherboard 150 may provide a robust connection between connector 100 and main or motherboard 150. Providing an opening 110 including contacts 120 and 130 may provide an easy way to attach daughter or optional board 160 to main or motherboard 150. In a specific embodiment of the present invention, when a connector 100 is attached to main or motherboard 150 and daughter or optional board 160, main or motherboard 150 may be approximately in line with daughter or optional board 160.

In this specific example, connector 100 may attach to main or motherboard 150 using a number of through-hole connections. In other embodiments of the present invention, other types of contacts may be utilized. For example, contacts 120 and 130 may include surface mount contacts for forming electrical connections with contacts on motherboard 150.

Again, it may be desirable to provide connectors that do not consume space in an electronic device that could otherwise be used to make the device smaller or to provide additional functionality (or both). In particular, it may be desirable to provide a connector having a low height or profile. Accordingly, embodiments of the present invention provide connectors having a low height or profile. This is shown in the following figure.

Figure 2:
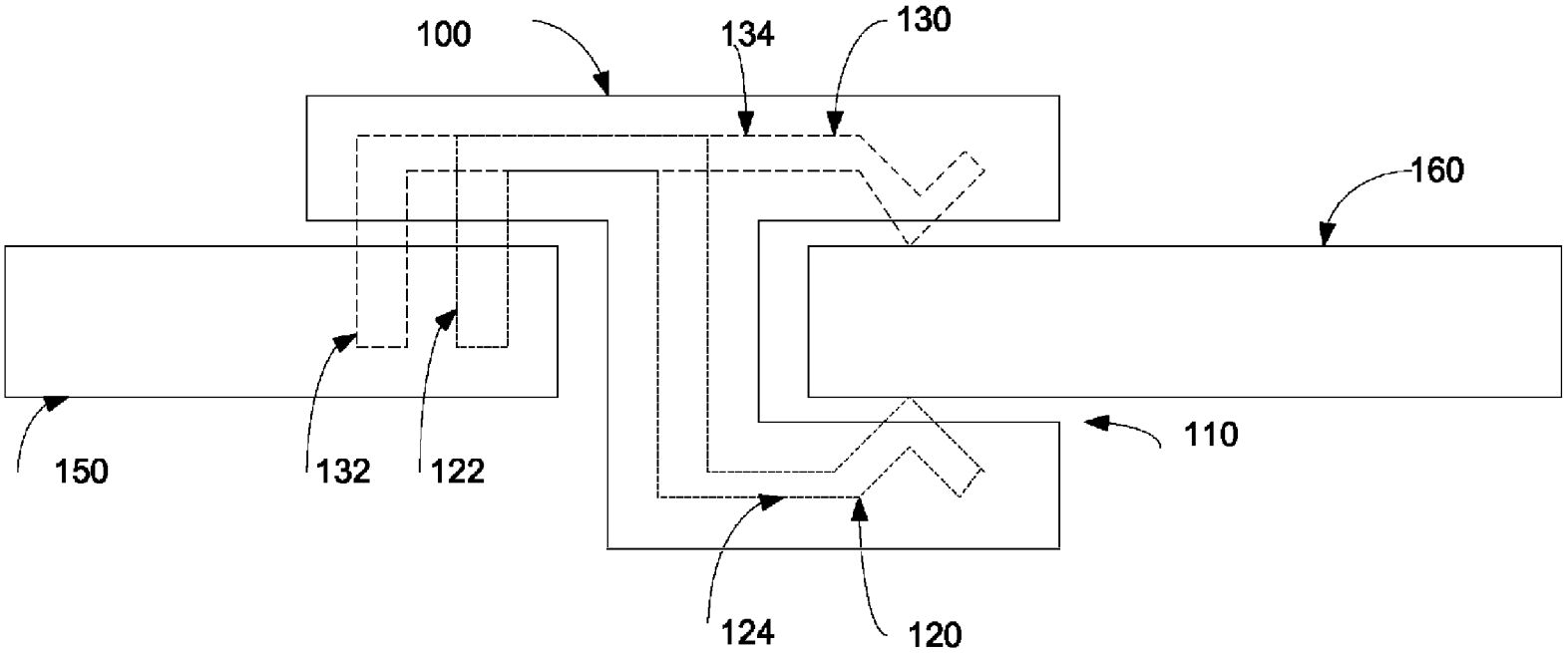
FIG. 2 illustrates a side view of a connector according to an embodiment of the present invention.

FIG. 2 illustrates a side view of a connector according to an embodiment of the present invention. This figure illustrates a side view of connector 100 that includes an opening 110, and contacts 120 and 130.

Contact 120 may include first prong 122 that may be inserted into a through hole in main or motherboard 150. Contact 120 may further include second prong 124 that may be located in the bottom of opening 110 of connector 100. This second prong 124 may form an electrical connection with a contact on daughter or optional board 160. First prong 122 may be at least approximately orthogonal to second prong 124.

Similarly, contact 130 may include first prong 132 that may be inserted into a through hole in main or motherboard 150. Contact 130 may further include a second prong 134 that may be located in the top of opening 110 of connector 100. This second prong 134 may form an electrical connection with a contact on daughter or optional board 160. First prong 132 may be at least approximately orthogonal to second prong 134.

Second contact prongs 124 and 134 may be arranged in a number of ways to accept and make contact with contacts on daughter or optional board 160. In a specific example of the present invention, second prongs 124 and 134 may be arranged such that daughter or optional board 160 is inserted at an angle, and then rotated until it is at least approximately aligned with main or motherboard 150.

Again, embodiments of the present invention may provide connectors that provide reliable manufacturing. A method of connecting a daughter or optional board to a main or motherboard is shown in the following figure.

Figure 3:
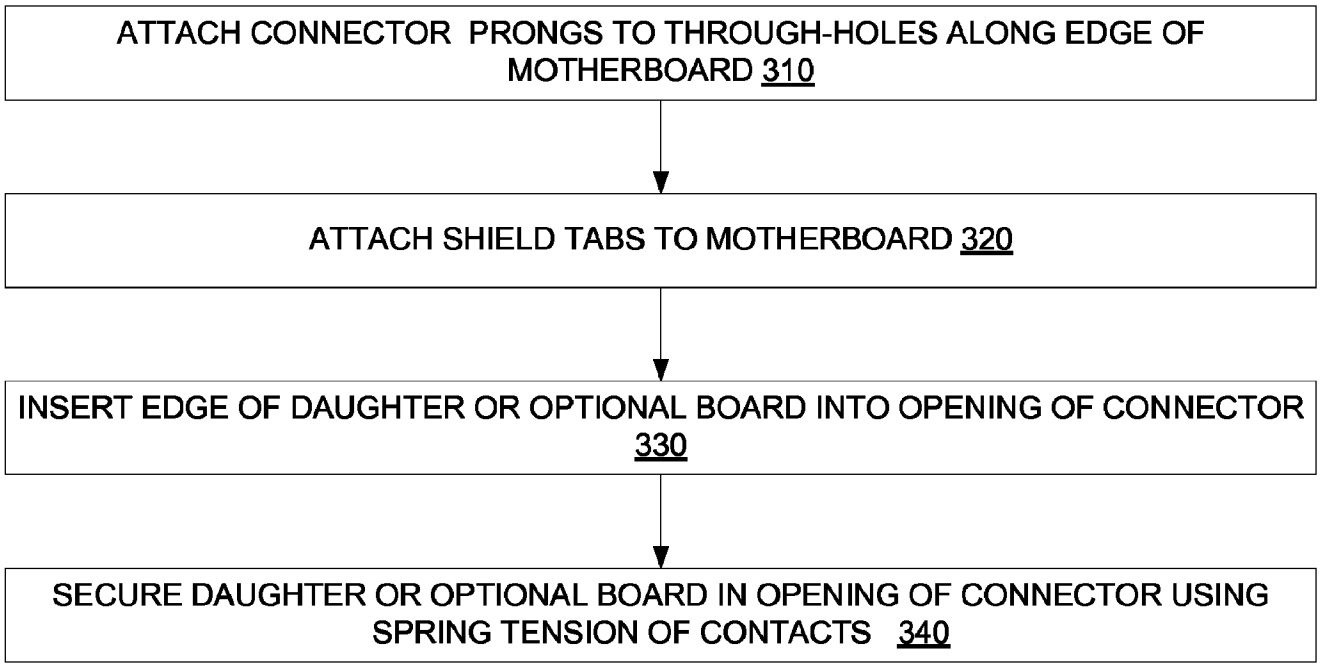
FIG. 3 illustrates a method of assembling an electronic device using a connector according to an embodiment of the present invention.

FIG. 3 illustrates a method of assembling an electronic device using a connector according to an embodiment of the present invention. In act 310, connector prongs may be attached to through holes along an edge of a main or motherboard. Shield tabs may be attached to the motherboard in act 320. These acts may provide a robust connection between a connector according to an embodiment of the present invention and a main or motherboard.

In act 330, an edge of a daughter or optional board is inserted into an opening of the connector. The daughter or optional board may be secured in the opening of the connector using spring tension of the contacts in act 340. Additional mechanism, such as clips, holders, or other structures may be used to secure the daughter or optional board in the opening of the connector.

Again, in some embodiments of the present invention, daughter or optional board 160 may be inserted at an angle into opening 110 of connector 100. Once inserted, daughter or optional board 160 may be rotated into place. At this point, daughter or optional board 160 may be at least approximately aligned with main or motherboard 150. An example is shown in the following figure.

Figure 4:
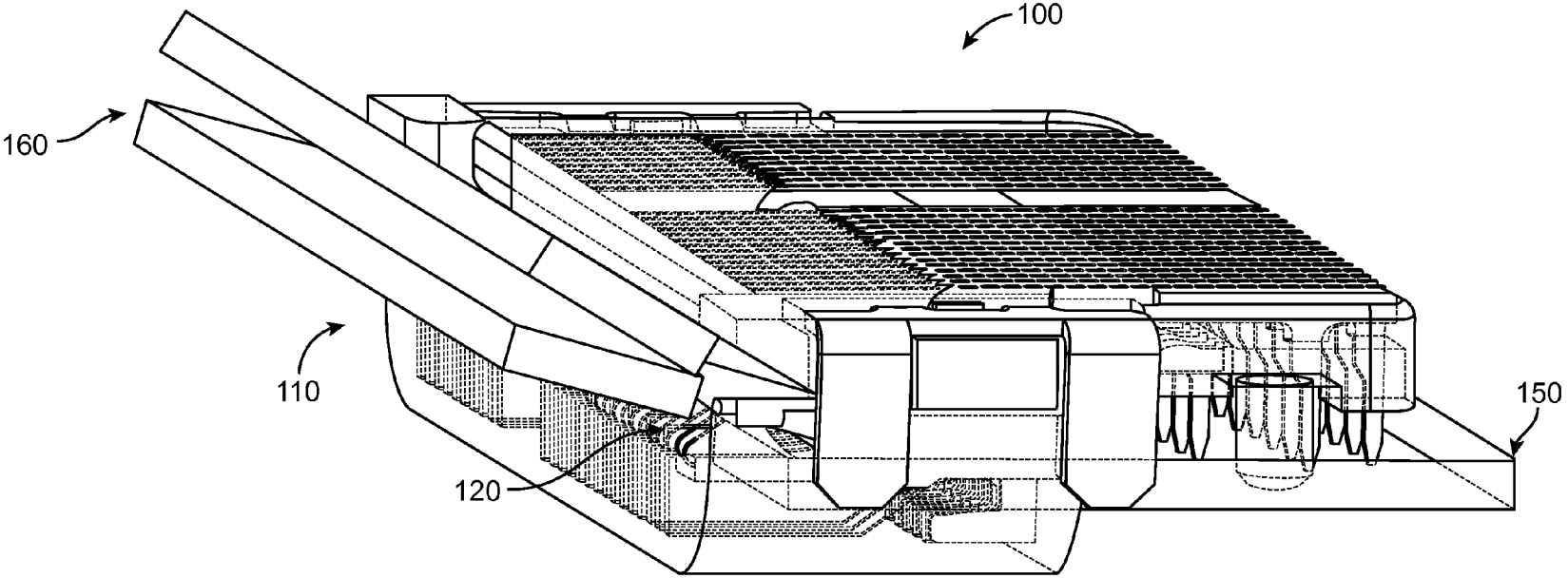
FIG. 4 illustrates a perspective view of a connector according to an embodiment of the present invention.

FIG. 4 illustrates a perspective view of a connector according to an embodiment of the present invention. This figure also includes a portion of main or motherboard 150, and a portion of daughter or optional board 160. In this example, daughter or optional board 160 may be inserted into opening 110 of connector 100. After insertion, daughter or optional board 160 may be rotated into place as shown. At this point, daughter or optional board 160 may be approximately in line with main or motherboard 160. Contacts 120 on a bottom of opening 110 may form electrical connections with contacts on a bottom of daughter or optional board 160. Similarly, contacts (not shown), on a top of opening 110 may form electrical connections with contacts on the top of 160.

Figure 5:
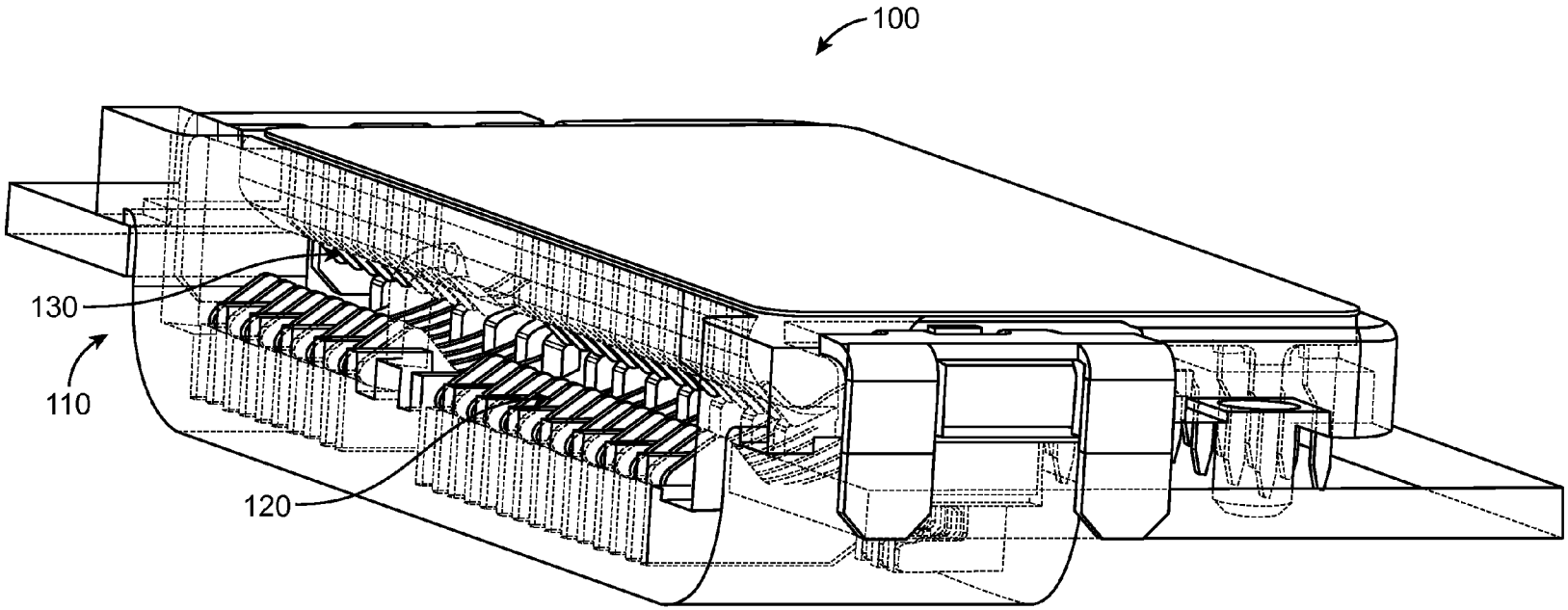
FIG. 5 illustrates contacts along the top of an opening of a connector and contacts along a bottom of an opening of a connector.

FIG. 5 illustrates contacts 130 along the top of opening 110 of connector 100 and contacts 120 along a bottom of opening 110 of connector 100.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector comprising:

a housing having an opening to receive a first board; and a plurality of contacts, each comprising:

a first prong to mate with a through hole on a second board; and a second prong to form an electrical connection with a contact on the first board, wherein when the first board is inserted in the opening of the housing and the first prongs of the plurality of contacts are mated with through holes on the second board, the first board and the second board are at least approximately in a line, and wherein the second prongs of the plurality of contacts hold the first board in place using spring tension.

2. The connector of claim 1 wherein a first number of the second prongs of the plurality of contacts form electrical connections with contacts on a first side of the first board, and a second number of the second prongs of the plurality of contacts form electrical connections with contacts on a second side of the first board.

3. The connector of claim 2 wherein the first number is twenty-five.

4. The connector of claim 2 wherein the first number is equal to the second number.

5. The connector of claim 1 wherein the first board comprises circuitry for cellular communications.

6. The connector of claim 5 wherein the second board comprises circuitry for a table computer.

7. The connector of claim 1 further comprising a plurality of tabs.

8. The connector of claim 7 wherein the plurality of tabs are part of a shield for the connector.

9. The connector of claim 1 further comprising a plurality of tabs to connect to the second board.

10. The connector of claim 1 wherein the first board is held in place only by the second prongs of the plurality of contacts.

11. An electronic device comprising a connector, the connector comprising:

a housing having an opening, the opening having a top and a bottom;

a first plurality of contacts, each of the first plurality of contacts comprising a first through-hole prong and a second prong, the second prong in the top of the opening in the housing, the first through-hole prong at least approximately orthogonal to the second prong; and a second plurality of contacts, each of the second plurality of contacts comprising a first through-hole prong and a second prong, the second prong in the bottom of the opening in the housing, the first through-hole prong at least approximately orthogonal to the second prong, wherein the opening is arranged to accept a first board and the second prongs of the first and second plurality of contacts hold the first board in place using spring tension.

12. The electronic device of claim 11 wherein the first through-hole prongs of the first and second plurality of contacts are arranged to be inserted into through holes of a second board.

13. The electronic device of claim 12 wherein when the first board is inserted in the opening of the housing and the first prongs of the first and second pluralities of contacts are mated with through holes on the second board, the first board and the second board are at least approximately in a line.

14. The electronic device of claim 12 wherein the electronic device comprises a tablet computer.

15. The electronic device of claim 14 wherein the first board comprises circuitry for cellular communications.

16. The connector of claim 12 further comprising a plurality of tabs.

17. The connector of claim 16 wherein the plurality of tabs are part of a shield for the connector.

18. The electronic device of claim 11 wherein the first board is held in place only by the second prongs of the first and second plurality of contacts.

* * * * *